United States Patent [19]

Larson

[11] 4,134,340

[45] Jan. 16, 1979

[54] THERMOPLASTIC FRAME FOR SILK-SCREEN

[75] Inventor: Ernst R. Larson, Stockholm, Sweden

[73] Assignee: K. E. Levin Maskin AB, Stockholm, Sweden

[21] Appl. No.: 787,117

[22] Filed: Apr. 13, 1977 (Under 37 CFR 1.47)

[30] Foreign Application Priority Data

Apr. 13, 1976 [SE] Sweden ..... 7604315

[51] Int. Cl.[2] ..... B41F 15/36

[52] U.S. Cl. ..... 101/127.1

[58] Field of Search ..... 101/127.1, 128.1, 128.4; 156/163, 267; 140/107-109

[56] References Cited

U.S. PATENT DOCUMENTS

| | | | |
|---|---|---|---|
| 3,214,314 | 10/1965 | Rowbottam | 156/267 X |
| 3,507,062 | 4/1970 | Moyer | 101/127.1 X |
| 4,026,208 | 5/1977 | Horne et al. | 101/127.1 X |
| 4,028,230 | 6/1977 | Rosenblum | 101/127.1 X |

FOREIGN PATENT DOCUMENTS

| | | | |
|---|---|---|---|
| 2302855 | 3/1975 | France | 101/127.1 |

*Primary Examiner*—Ronald E. Suter

*Attorney, Agent, or Firm*—Sughrue, Rothwell, Mion, Zinn

[57] ABSTRACT

A frame for silk-screen printing holding a cloth of thermoplastic material attached to a thermoplastic frame surface is disclosed. The frame elements comprise a rectangular metal frame with each element having a metal bar with outwardly directed flanges attached to it. A series of contoured plastic strips having channels engage each of the flanges and are slidably mounted on each bar. The cloth is stretched across the contoured plastic strips and by the application of heat the strips melt and fuse with the cloth.

2 Claims, 8 Drawing Figures

Fig. 1
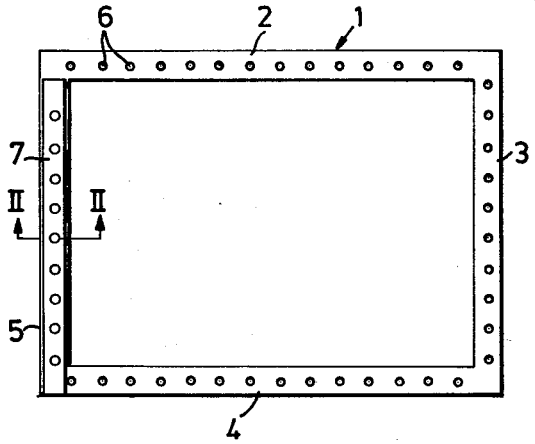
Fig. 2
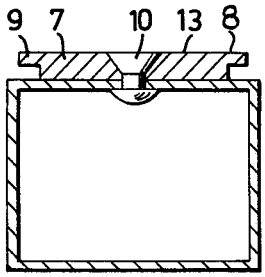
Fig. 3
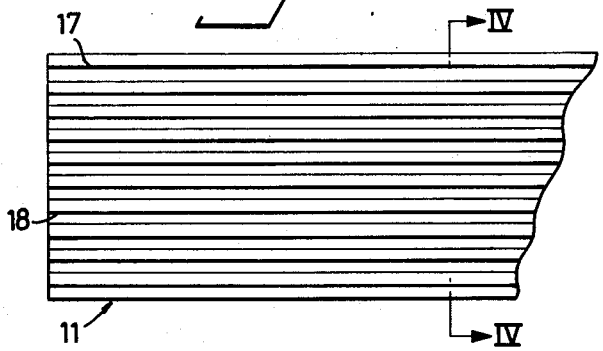
Fig. 4
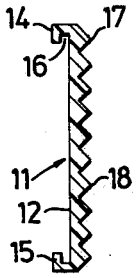
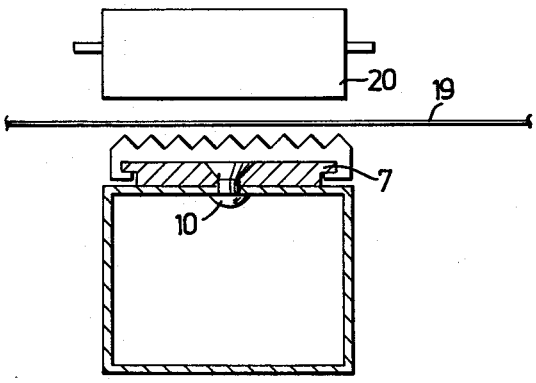
Fig. 5

THERMOPLASTIC FRAME FOR SILK-SCREEN

The invention relates to a frame for silk-screen printing, on which a cloth of thermoplastic material is to be fixed under tension.

The usual method of fixing a stretched silk-screen cloth on the tensioning device or the so-called "frame" consists of cementing with different kinds of cement, e.g. 1- or 2- component cements. These fixing materials, exellent per se, have several drawbacks, such as the necessity of using environmentally dangerous solvents for cleaning pigment and stencil ink from the screen. Environmentally innocuous cleaning agents cannot be used, since they dissolve the 1- and 2- component cements available, and thereby release the screen from the frame. A further drawback with gluing fast the screen to the frame is that after the screen has become worn and must be replaced, one is compelled to grind away the remains from the frame, which is preferably made from steel, resulting in the occurance of grinding dust which is spread in the surroundings and can cause discomfort and injury on aspiration.

It is, therefore, a main object of the invention to provide a frame on which the screen is fixed completely mechanically without using clumsy and expensive stretching means, and this object is achieved by the device disclosed in the patent claims.

Figure 6:
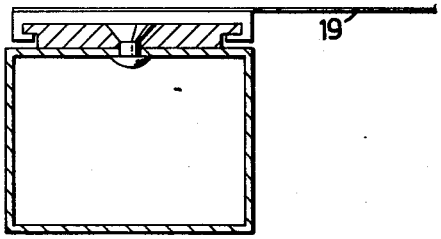
Figure 7:
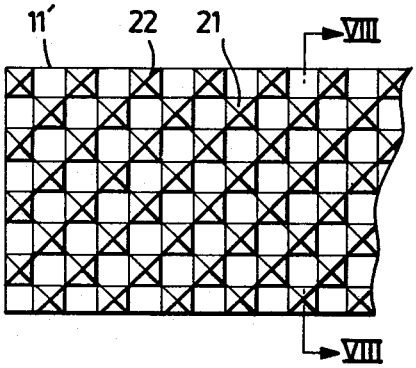
Figure 8:
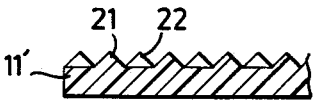

Different embodiments of the invention are described below while referring to the attached drawings, on which FIG. 1 shows a frame seen from above, FIG. 2 is a section along the line II—II in FIG. 1, illustrating a part of a fastening means for the screen, said fastening means being rivetted to the flat surface surface of the frame facing the screen, FIG. 3 illustrates in a simplified way a portion of a screen retainer according to the invention, FIG. 4 is a section along the line IV—IV in FIG. 3, FIG. 5 shows the screen retainer according to FIG. 3, slid on to the device according to FIG. 2, and with a cloth lying above it in position for attachment to the screen retainer, FIG. 6 shows the screen after it has been attached to the screen retainer according to FIG. 5, FIG. 7 shows the upper surface of a modified screen retainer, and FIG. 8 is a section along the line VIII—VIII in FIG. 7.

FIG. 1 shows a steel frame 1, in this case provided with holes 6 along four members 2,3,4 and 5 forming the sides of the frame, said holes 6 being provided for attaching a shaped bar 7 (FIG. 2) of metal or plastic. In FIG. 1, such a bar has been indicated in place on the side member 5, and it is apparent that the bar extends from the lower edge of the side member 5 and up to the inner side face of the upper side member 2 in FIG. 1. On each of the frame members 2 to 5 there is arranged a bar of the type shown in FIG. 2, i.e. a bar shaped to have longitudinal, outwardly directed flanges 8 and 9. The bar is fastened with rivets 10 going through the holes 6 in the frame.

FIGS. 3 and 4 illustrate a screen retainer 11 according to the invention, made from a plastic material, e.g. a polyester plastic, which can be brought into a sticky and melted state by the application of heat. The screen retainer 11, which in its effective position is mounted to extend over the whole of the frame surface, is made in four lengths, each length corresponding to the associated bar 7, and has a flat bottom surface 12, arranged to lie against the upper flat surface 13 of the bar 7. Each screen retainer portion is provided with two inwardly directed flanges 14 and 15 on its underside, there being a channel 16 formed between the respective flange and the surface 12 for engaging complementally with the flanges 8,9 on an associated bar 7 when the screen retainer portion is slid on to the bar from one end thereof. The screen retainer portions are very thin in proportion to the frame, e.g. with a thickness of 1 to 4 mm. In the embodiment according to FIGS. 3 and 4 the upper surface of the screen retainer, against which the printing screen is to be placed, is provided with longitudinal ridges, e.g. ridges 17 and 18, extending along the whole of the screen retainer portion and in the direction of the appropriate frame member, e.g. frame member 5. Subsequent to all of the frame members 2 to 5 pertaining to the frame 1 having been provided with a screen retainer portion according to the FIGS. 3 and 4, the frame 1 is placed under a stretched cloth 19, as shown in FIG. 5. A heating means 20, such as a hot tool, an induction heater, an infra-red lamp or the like, is then applied to the cloth. This tool has a temperature sufficient for causing the material in the ridges of the screen retainer 11 to become sticky or melted. The tool is applied to the whole of the screen retainer, i.e. around the whole of the frame 1, whereby the ridges are melted down and the cloth 19 is pressed into the sticky or half melted plastic mass formed by the ridges, and which, after the tool 20 has been removed and the melted or sticky plastic has solidified, is firmly united with the screen retainer 11, as illustrated in FIG. 6.

The screen 19 is thus firmly connected to the frame by the screen retainer 11 without any bonding means which can be dissolved in the solvents or detergents used for cleaning the screen. When the screen 19 has become worn, it is quite simply cut away around the inside of the frame, and the portions of the screen retainer 11 are pulled away from the frame and now portions are slid on to receive a new cloth. Grinding down the frame is not required and, therefore, no injurious dust is generated. Since grinding is not required, the steel frame 1 can be given more slender dimensions than is the case with conventional frames, from which a portion of material is always removed during grinding.

In FIGS. 7 and 8 there is shown a modified embodiment of the screen retainer, and this screen retainer, generally denoted 11', is provided with pyramid-like protuberances over the whole of its surface facing towards the screen, e.g. protuberances 21 and 22. Complete melting-down of the protuberances 21 and 22 is not necessary but can be suitable for the best attachment of the screen. In the Figures, the screen retainers 11 and 11' have been shown to have substantially the same width as the side members of the steel frame, but they can, of course, be narrower or wider.

What I claim is:

1. In a frame for silk-screen printing arranged to have a cloth of thermoplastic material attached on a thermoplastic frame surface by the application of heat, the improvement comprising, a rectangular metal frame, said frame having side members, each of said side members provided with a metal bar on a face directed towards the cloth, each bar having longitudinal, outwardly directed flanges, said thermoplastic frame comprising a series of contoured plastic strips of thermoplastic material having generally the same length as the associated metal bar, each of said plastic strips having a longitudinal channel engaging said outwardly directed flanges on said bars for keeping the plastic strip on the metal bar, said plastic strips having surfaces facing towards the cloth.

2. A frame as claimed in claim 1, wherein the surface of each plastic strip facing towards the cloth protuberances configured to partially melt on the application of heat.

* * * * *